US007338141B2

(12) United States Patent
Kang et al.

(10) Patent No.: US 7,338,141 B2
(45) Date of Patent: Mar. 4, 2008

(54) CONTROL PANEL ASSEMBLY FOR WASHING MACHINE

(75) Inventors: Dong Won Kang, Changwon-si (KR); Moon Soo Song, Busan (KR)

(73) Assignee: LG Electronics Inc., Seoul (KR)

( * ) Notice: Subject to any disclaimer, the term of this patent is extended or adjusted under 35 U.S.C. 154(b) by 606 days.

(21) Appl. No.: 10/933,426

(22) Filed: Sep. 3, 2004

(65) Prior Publication Data

US 2005/0183471 A1 Aug. 25, 2005

(30) Foreign Application Priority Data

Feb. 25, 2004 (KR) ..... 10-2004-0012595

(51) Int. Cl.
*A47B 47/00* (2006.01)

(52) U.S. Cl. ..... 312/265.5; 312/263

(58) Field of Classification Search ..... 312/257.1, 312/265.5, 263, 228, 279, 265.6; 34/603; 68/3 R See application file for complete search history.

(56) References Cited

U.S. PATENT DOCUMENTS 3,253,874 A * 5/1966 Czech ..... 312/265.5
4,288,133 A * 9/1981 Deatherage ..... 312/279
4,429,817 A * 2/1984 Ikeda ..... 222/652
4,798,424 A * 1/1989 Coates et al. ..... 312/257.1
5,350,140 A * 9/1994 Ripley et al. ..... 248/27.1
5,584,563 A * 12/1996 Stottmann ..... 362/85
5,611,610 A * 3/1997 Katz et al. ..... 312/263
5,685,623 A * 11/1997 Katz et al. ..... 312/263

* cited by examiner

*Primary Examiner*—James O. Hansen
(74) *Attorney, Agent, or Firm*—McKenna Long & Aldridge LLP

(57) ABSTRACT

A control panel assembly for a washing machine is disclosed. The structure of the control panel assembly provided with a decoration member is greatly simplified. The control panel assembly includes a control panel mounted on an outer case of the washing machine, a first decoration member penetrating the control panel and enclosing a push button, a second decoration member enclosing the first decoration member. The second decoration member supports a rear side of the first decoration member and is supported by the control panel and the first decoration member. A transparent cover covers the control panel and supports a front portion of the first decoration member.

23 Claims, 4 Drawing Sheets

CONTROL PANEL ASSEMBLY FOR WASHING MACHINE

This application claims the benefit of Korean Application No. P2004-012595, filed on Feb. 25, 2004, which is hereby incorporated by reference.

BACKGROUND OF THE INVENTION

1. Field of the Invention

The present invention relates to a washing machine, and more particularly, to a control panel assembly for a washing machine, by which a user controls an operation of the washing machine.

2. Discussion of the Related Art

Generally, a washing machine is a representative home appliance for removing filth or dirt attached to a laundry using a reaction between water and detergent. A control panel is provided to a front side or topside of the washing machine to enable a user to operate the corresponding washing machine. Recently, in order to enhance an exterior beauty of a washing machine, a decoration is provided to the control panel as well as various keys and buttons.

However, in case of providing the decoration, a control panel size increases despite the enhanced exterior beauty of the washing machine. Moreover, as an assembly structure of the decoration and control panel is complicated, the decoration has difficulty in being assembled to the control panel, thereby reducing productivity thereof.

SUMMARY OF THE INVENTION

Accordingly, the present invention is directed to a control panel assembly for a washing machine that substantially obviates one or more of the problems due to limitations and disadvantages of the related art.

An object of the present invention, which has been devised to solve the foregoing problem, lies in providing a control panel assembly for a washing machine, by which a structure of the control panel assembly provided with a decoration becomes compact and simplified.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, a control panel assembly for a washing machine includes a control panel mounted on an outer case of the washing machine, a first decoration member penetrating the control panel and enclosing a push button, a second decoration member enclosing the first decoration member, the second decoration member supporting a rear side of the first decoration member, the second decoration member being supported by the control panel and the first decoration member, and a transparent cover covering a front side of the control panel and supporting a front portion of the first decoration member.

The control panel includes an information sheet attached to the front side of the control panel. The control panel may also include a first opening penetrated by the first decoration member, and at least one hook extending backward from a rear circumferential edge of the first opening.

Herein, the first opening has a diameter greater than that of the first decoration member, and a front portion of the second decoration member is provided between an inner surface of the first opening and an outer surface of the first decoration member. And, the at least one hook may include a first hook fastened to a rear side of the second decoration member, and a second hook fastened to a portion of the first decoration member.

The first decoration member may include an opening accommodating the push button, an extension extending backward from the rear side of the first decoration member and being bent to support a rear side of the second decoration member in part, and a stepped portion provided along an outer circumference of the front portion of the first decoration member to be supported by the cover. Herein, the control panel includes a hook extending backward from a rear side of the control panel to be fastened to the extension of the first decoration member.

The second decoration member includes a transparent layer provided between an outer circumference of the first decoration member and the control panel, and an information sheet attached to the transparent layer. The second decoration member also includes an opening accommodating the first decoration member, a first stepped portion provided along an outer circumference of the second decoration member to be in contact with the control panel, and a second stepped portion provided along an inner circumference of the second decoration member to support the rear side of the first decoration member.

Herein, the second decoration member may include a channel perforating the second stepped portion to be penetrated by a portion of the first decoration member. Also, the first and second decoration members are ring-shaped, respectively. The transparent cover includes an opening accommodating the front portion of the first decoration member, and at least one extension stably fitted to the control panel.

In another aspect of the present invention, a control panel assembly for a washing machine includes a control panel mounted on an outer case of the washing machine including a first opening, and at least one hook extending backward from a rear circumferential edge of the first opening, a first decoration member inserted in the first opening, wherein the first decoration member includes a second opening to accommodate a push button therein, a second decoration member supported by a rear side of the control panel and the hook, wherein the second decoration member includes a third opening to accommodate the first decoration member therein, and a transparent cover covering a front side of the control panel, wherein the transparent cover includes a fourth opening to accommodate a front portion of the first decoration member.

In a further aspect of the present invention, a control panel assembly for a washing machine includes a control panel mounted on a case of the washing machine including a first opening, and first and second hooks, each hook extending backward from a rear circumferential edge of the first opening, a first decoration member inserted in the first opening, wherein the first decoration member includes a second opening to accommodate a push button therein, a first extension extending from a rear side of the first decoration member to have the second hook fastened to an end portion of the first extension, and a first stepped portion provided along an outer circumference of a front portion of the first decoration member. The control panel assembly also includes a second decoration member having the first hook fastened to a rear side of the second decoration, wherein the second decoration member includes a third opening to accommodate the first decoration member therein, a second stepped portion provided along an outer circumference of the second decoration member to be held in the first opening, and a third stepped portion provided along an inner circumference of the second decoration member to support the rear side of the first decoration member, and a transparent cover covering a front side of the control panel. Herein, the transparent cover includes a fourth opening to accommodate the first stepped portion, and at least one second extension stably fitted to the control panel to be fixed thereto.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Throughout the drawings, like elements are indicated using the same or similar reference designations where possible.

Figure 1:
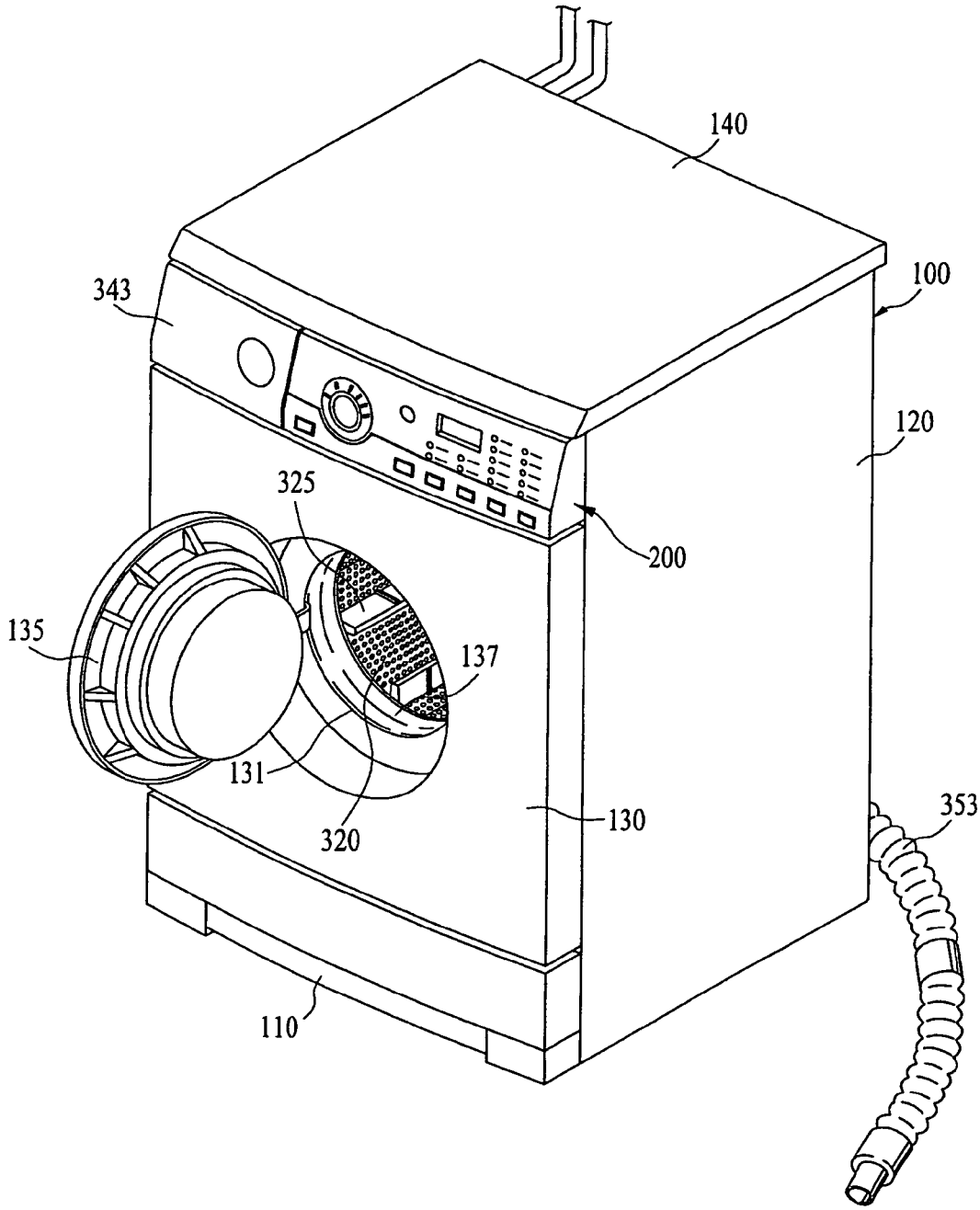
FIG. 1 is a perspective diagram of a washing machine provided with a control panel assembly according to the present invention.
Figure 2:
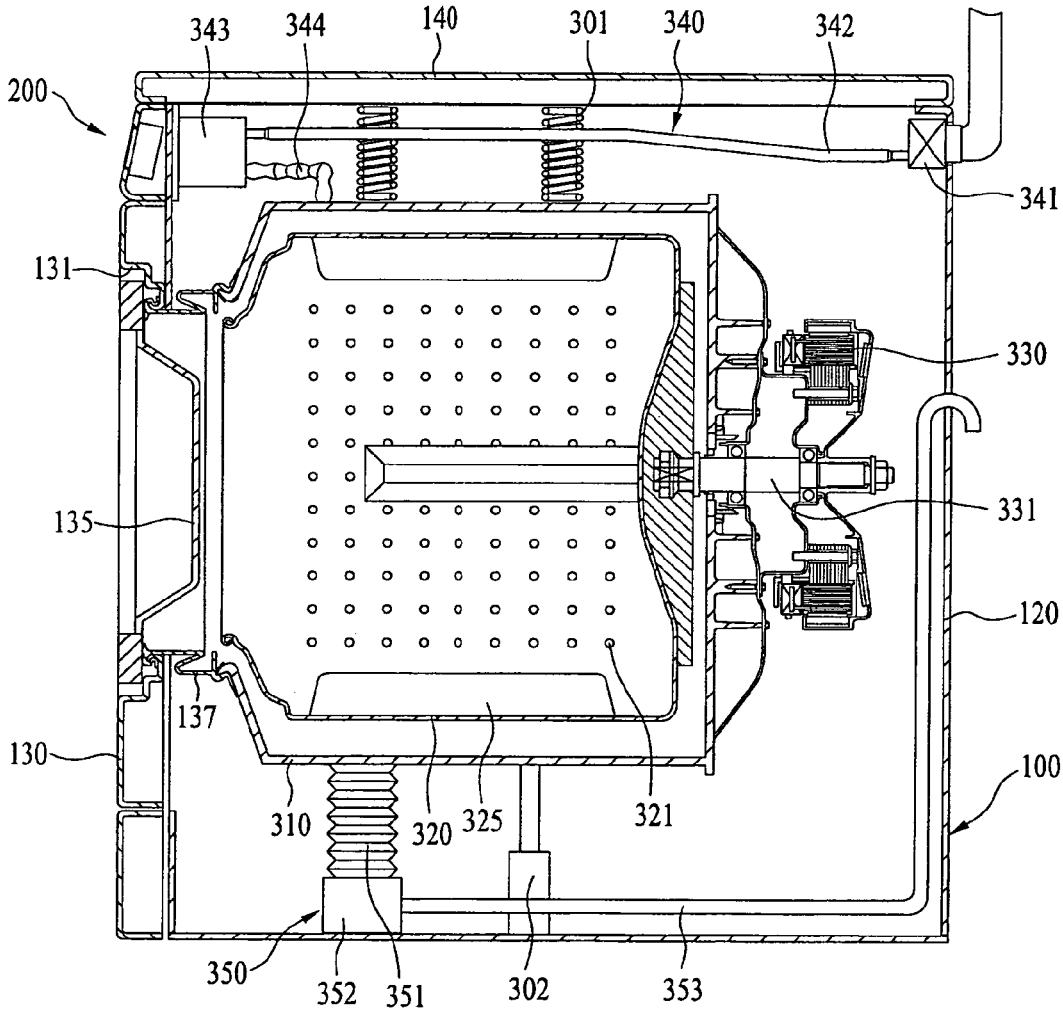
FIG. 2 is a cross-sectional diagram of the washing machine in FIG. 1.

FIGS. 1 and 2 show a washing machine provided with a control panel assembly 200 according to the present invention. A configuration of the washing machine according to the present invention is explained in detail by referring to the attached drawings as follows. Referring to FIG. 1, a case 100 of a washing machine includes a base plate 110, a wall 120, a front cover 130, a top plate 140, and a front plate 150. The wall 12 0 is provided on the base plate 110 to form both lateral sides and rear side of the case 100. The front cover 130 is provided in front of the wall 120 to form a front side of the case 100. The top plate 140 is provided over the wall 120 to form a topside of the case 100.

Referring to FIG. 2, a tub 310 is suspended within a case 100. For this, an upper part of the tub 310 is connected to a spring 301 fixed to the case 100 and a lower part of the tub 310 is connected to a damper 302 connected to a bottom surface of the case 100 via hinge. The above-provided spring 301 and damper 302 play a role in attenuating vibration appearing on the tub 310 in the course of operating a washing machine as well as elastically suspending the tub 310 within the case 100. A drum 320 is rotatably provided within the tub 310. For this, a motor 330 is provided within the case 100, and more particularly, in rear of the tub 310. And, the drum 320 is connected to the motor 330 via shaft 331.

A multitude of perforated holes 321 perforate a circumference of the drum 320 and a plurality of tumbling ribs 325 are provided on an inner circumference of the drum 320. Hence, water supplied to the tub 310 enables to communicate between the drum 320 and the tub 310 via the perforated holes 321. A laundry held in the drum 320 is lifted upward to fall by the tumbling ribs 325 while the drum 320 is rotated. Hence, friction and impact energy sufficient for washing can be provided when the laundry falls by the tumbling ribs 325. An opening 131 is provided to a front side of the case 100 so that a user can put/pull the laundry in/from the drum 320 and a door is provided to open/close the opening 131. A gasket 137 is provided between the opening 131 of the case 100 and the tub 310 to prevent water/laundry held in the drum 320 and/or tub 310 from leaking/escaping.

Meanwhile, a water supply system 340 and drain system 350 are provided within the case 100. The water supply system 340 includes an inlet valve 341, an inlet hose 342, a detergent box 343, and an inlet bellows 344. The inlet valve 341 opens or closes a passage of water supplied from outside, and the inlet hose 342 connects the inlet valve 341 and the detergent box 343. And, the inlet bellows 344 connects the detergent box 343 and the tub 310. Once the inlet valve 341 is turned on, water is passed through the inlet hose 342, detergent box 343, and inlet bellows 344 in turn to be supplied to the tub 310. In this case, a detergent stored in the detergent box 343 is supplied to the water if necessary.

The drain system 350 includes a drain bellows 351, a drain pump 352, and a drain hose 353. The drain bellows 351 connects the tub 310 and the drain pump 352. One end of the drain hose 353 is connected to the drain pump 352 and the other end of the drain hose 353 communicates with outside of the case 100. Hence, once the drain pump 352 is driven, water held in the tub 310 is passed through the drain bellows 351, the drain pump 352, and the drain hose 353 in turn to be discharged outside.

Meanwhile, a control panel assembly 200 is provided to one side of the case 100, e.g., an upper front side of the case 100, to enable a user to control the washing machine. The control panel assembly 200 is arranged on a front cover 130. A configuration of the control panel assembly 200 is shown in FIGS. 3 and 4, which is explained in detail by referring to the attached drawings as follows.

Figure 3:
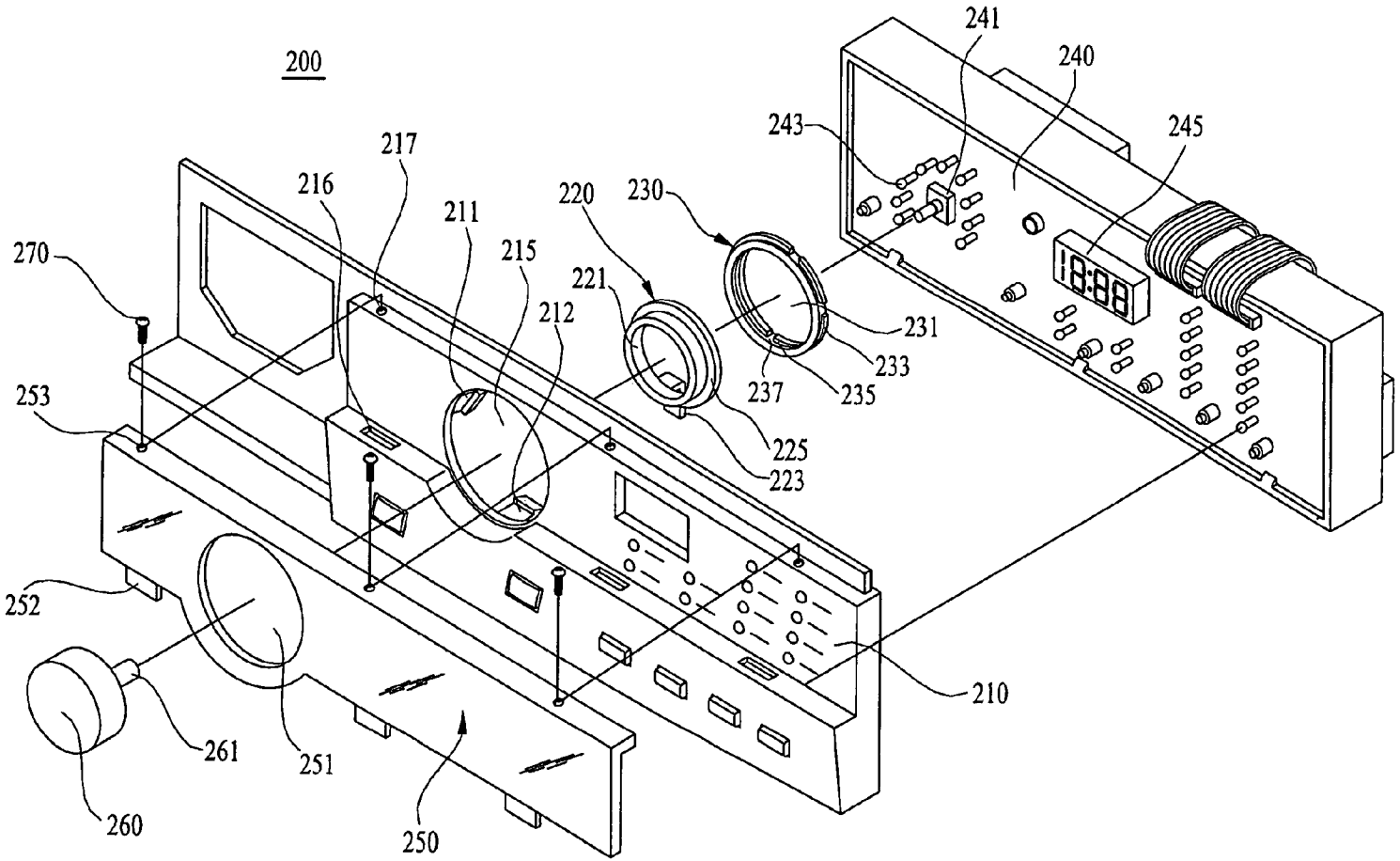
FIG. 3 is a projected perspective diagram of the control panel assembly in FIG. 1.

First of all, the control panel assembly 200, as shown in FIG. 3, includes a control panel 210 loaded on the case 100, a first decoration member 220 penetrating the control panel 210, a second decoration member 230 enclosing the first decoration member 230, and a transparent cover 250 attached to the control panel 210. For instance, the control panel 210 is attached to an upper front side of the case 100. A first information sheet 214 is provided to a front side of the control panel 210. Numerical figures, characters, diagrams, and the like are displayed on the first information sheet 214 to provide information to a user. A first opening 215 is provided to the control panel 210. And, the first decoration member 220 penetrates the first opening 215 to be loaded therein.

At least one or more hooks, e.g., first and second hooks 211 and 212, extend backward from a rear side of the control panel 210 in the vicinity of the control panel 210. The first hook 211 is caught on (or fastened to) a rear side of the second decoration member 230 and the second hook 212 is caught on a portion of the first decoration member 220. Yet, limitation is not put on where the hooks 211 and 212 are caught. For instance, the second hook 212 can be caught on the rear side of the second decoration member 230 as well.

Figure 4:
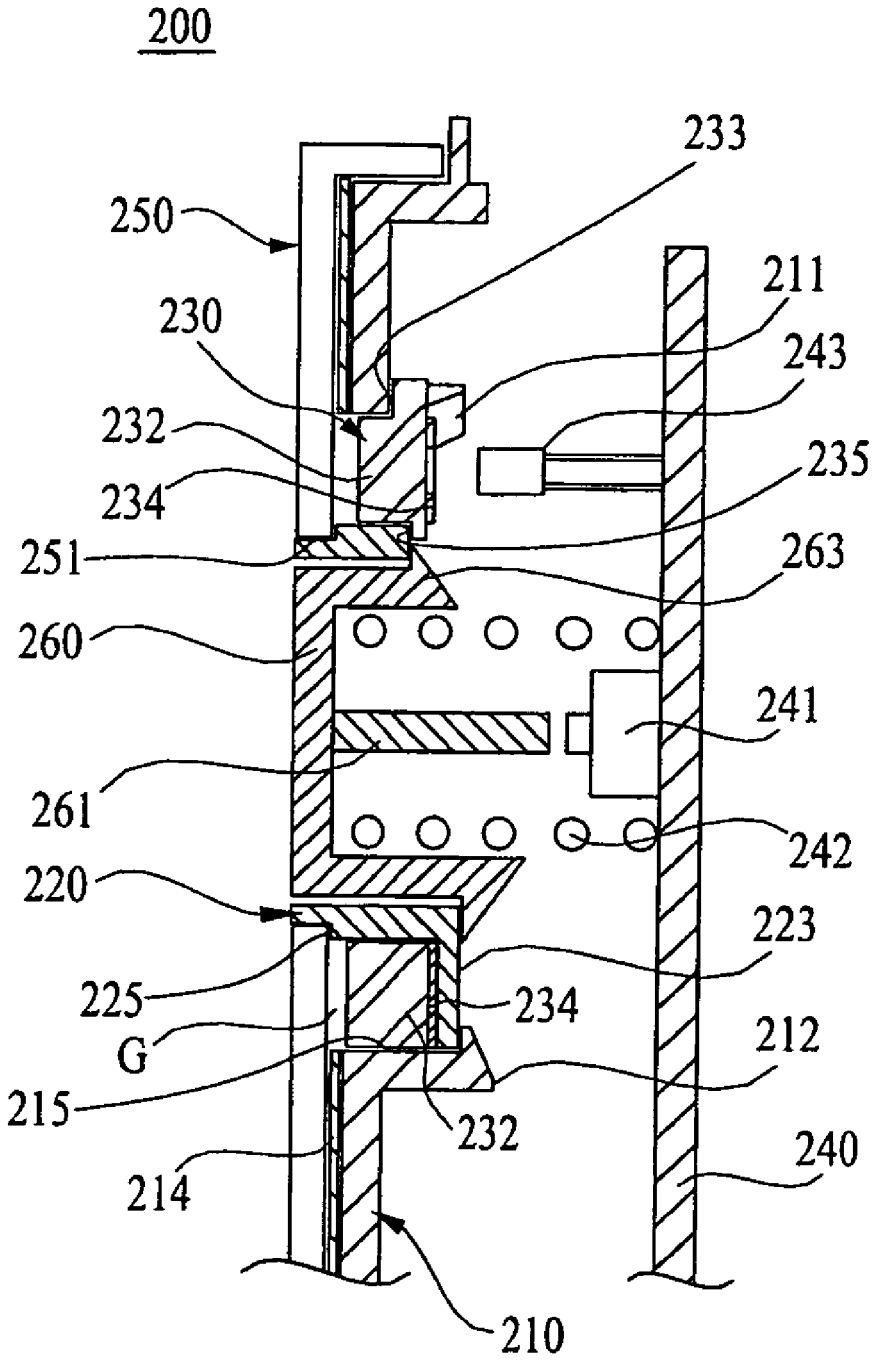
FIG. 4 is a cross-sectional diagram of the control panel assembly in FIG. 1.

Meanwhile, a circuit board 240, as shown in FIGS. 2 to 4, is provided between the control panel 210 and the front side of the case 100. In this case, at least one or more switches 241, LEDs 243, display 245, and the like, as shown in FIG. 3, are provided to the circuit board 240. For reference, one of the switches 241 is provided to a location confronting the first opening 215 when the control panel 210 is assembled to the case 100. And, some of the LEDs 243 are arranged to enclose the switch 241 provided to the location confronting the first opening 215. The above-arranged LEDs 243 come into confronting the second decoration member 230 when the control panel 210 is loaded on the case 100. Meanwhile, the first decoration member 220, as shown in FIG. 4, is inserted in the first opening 215 and has a ring shape to enclose a button 260. For this, a second opening 221 is provided to a center of the first decoration member 220 to accommodate the button 260 and the button 260 is installed to penetrate the second opening 221.

A rod 261 is provided to the button 260 to confront the switch 241 corresponding to the first opening 215. And, a hook 263 caught on the rear side of the first decoration member 220 is provided to the button 260 to prevent the button 260 from escaping from the second opening 221. Moreover, as shown in FIG. 4, a spring 242 is provided between a rear side of the button 260 and a front side of the circuit board 240.

And, a first extension 223 extends backward from a rear side of the first decoration member 220. The first extension 223 has an angle shape bent in an outer radial direction of the first decoration member 220 after extending to a predetermined length from the rear side of the first decoration member 220. A bent end portion of the first extension 223 supports a portion of a rear side of the second decoration member 230. And, the second hook 212 of the control panel 210 is caught on the bent end portion of the first extension 223. Moreover, as shown in FIGS. 3 and 4, a first stepped portion 225 is provided to the front side of the first decoration member 220. The first stepped portion 225 is provided along an outer circumference of the front side of the first decoration member 220. And, a portion of the cover 250 is mounted on the stepped portion 225 to be supported thereon.

Meanwhile, a diameter of the first opening 215 is greater than that of the first decoration member 220. Hence, a gap G is provided between an inner circumference of the first opening 215 and an outer circumference of the first decoration member 220, as shown in FIG. 4. A portion of the second decoration member 230, e.g., a front side of the second decoration member 230, is fitted in the gap G to be fixed thereto. For instance, as shown in FIGS. 3 and 4, the second decoration member 230 has a ring shape and is provided to enclose the first decoration member 220. The second decoration member 230 is held by the control panel 210 and the first decoration member 220. A structure of the second decoration member 230 is explained in detail with reference to FIGS. 3 and 4 as follows.

A third opening 231 is provided to a center of the second decoration member 230 to hold the first decoration member 220 therein. A second stepped portion 233 is provided to an outer circumference of the second decoration member 230. Hence, the front side of the second decoration member 230, as shown in FIG. 4, is fitted in the gap G to be fixed thereto and the rear side of the control panel 210, and more particularly, the circumference of the first opening 215 comes into contact with the second stepped portion 233 to be supported thereon.

Moreover, a third stepped portion 235 is provided to an inner circumference of the second decoration member 230. The third stepped portion 235 supports a rear side of the first decoration member 220 held in the third opening 231. Furthermore, a channel 237 is provided to the third stepped portion 235 of the second decoration member 230. The channel 237 communicates with the third opening 231 to be provided in a front-to-rear direction. When the first and second decoration members 220 and 230 are assembled, the channel 237 is penetrated by a portion of the first decoration member 220, and more particularly, by the first extension 223.

Meanwhile, a transparent layer 232 and second information sheet 234 are provided to the second decoration member 230, as shown in FIG. 4. The transparent layer 232 is provided at least between the outer circumference of the first decoration member 220 and the control panel 210. Hence, light of the LED 243 provided to the circuit board 240 can be emitted to the front side of the control panel 210 via the transparent layer 232 of the second decoration member and the gap G.

And, the second information sheet 234 is provided to either a front side of the transparent layer 232 or a rear side thereof. Such information necessary for a user as an operational option, time, and the like is displayed on the second information sheet 234 by numerical figures, characters, diagrams, and so on. For reference, as shown in FIG. 4, the second information sheet 234 is attached to the rear side of the transparent layer 232.

Meanwhile, the transparent cover 250 is arranged on the front side of the control panel 210. The transparent cover 250 is detachably attached to the control panel 210 to protect the control panel 210 and to hold the front side of the first decoration member 220. A fourth opening 251 is provided to the cover 250. And, the front side of the first decoration member 220 is held in the fourth opening 251. Specifically, the front side of the first decoration member 220 is inserted in the fourth opening 251, and a circumference of the fourth opening 251 on the rear side of the cover 250 is supported by the first stepped portion 225 of the first decoration member 220.

And, at least one or more second extensions 252, as shown in FIG. 3, protrude downward from a lower side of the cover 250. For instance, a plurality of the second extensions 252 are arranged to leave an equal distance from each other so as to be respectively fitted in the control panel 210 to be fixed thereto. For this, at least one slot 216, as shown in FIG. 3, is provided to the control panel 210 to hold the corresponding second extension 252 therein.

Moreover, at least one aperture 253 is provided to a topside of the cover 250 and at least one another aperture 217 is provided to an upper part of the control panel 210 to confront the former aperture 253. For instance, a plurality of the apertures 253 or 217 are arranged to leave a predetermined interval from each other. As shown in FIG. 3, a locking member 270, such as a screw and the like penetrates both of the corresponding apertures 253 and 217 in assembling the cover 250 and control panel 210.

The above-configured control panel assembly 200 according to the present invention is assembled in the following manner.

First of all, the first decoration member 220 is placed in front of the second decoration member 230. The first and second decoration members 220 and 230 are then assembled to each other. In doing so, the first extension 223 of the first decoration member 220 is passed through the channel 237 to be caught on the rear side of the second decoration member 230, and the first decoration member 220 is then pushed backward to be fitted in the third opening 231 of the second decoration member 230. Subsequently, the assembly of the first and second decoration members 220 and 230 is fitted in the first opening 215 of the control panel 210. In doing so, the assembly of the first and second decoration members 220 and 230 is moved from the rear side of the control panel toward the front side thereof to be fitted in the first opening 215.

Once the assembly of the first and second decoration members 220 and 230 is fitted in the first opening 215, the front side of the first decoration member 220 is exposed in front of the first opening 215 of the control panel 210, the front side of the second decoration member 230 is fitted in the gap G, and the second stepped portion 233 is in contact with the rear side of the control panel 210 to support. Moreover, as shown in FIG. 4, the first hook 211 is caught on the rear side of the second decoration member 230 and the second hook 212 is caught on the bent end portion of the first extension 223.

Once the assembly of the first and second decoration members 220 and 230 is loaded inn the control panel 210, the transparent cover 250 is attached to the front side of the control panel 210. For this, after the second extension 252 has been inserted in the slot 216 of the control panel 210, the upper part of the cover 250 is pushed toward the control panel 210. Thus, the front side of the first decoration member 220 is fitted in the fourth opening 251 of the cover 250 and the first stepped portion 225 supports the rear side of the cover 250 in the vicinity of the fourth opening 251, as shown in FIG. 4. Finally, while the above-described structure is maintained, the locking member 270 is fitted in both of the apertures 253 and 217 to be locked therein.

A washing machine having the above-configured control panel assembly 200 loaded thereon according to the present invention is operated in the following manner. First of all, a laundry is put in the drum 320, the door 135 is closed, and the control panel assembly 200 is then operated. Once the washing machine is actuated after setting washing, rinsing, dewatering, and drying cycles, the water supply system 340 supplies a predetermined amount of water and detergent to the drum 320. As the drum 320 is rotated, the laundry is lifted by the tumbling rib 325 to fall. In doing so, the laundry is washed by the generated impact power and the chemical reaction of detergent.

After completion of the washing cycle, the drain system 350 discharges the used water of the drum 320 and tub 310. After completion of drain, the water supply system 340 supplies water to the drum 320. The drum 320 is then rotated to rinse the laundry. After completion of the rinsing cycle, the drain system 350 discharges the water of the drum 310. In this case, at least one washing cycle is carried out. After completion of the rinsing cycle, the drum 320 is rotated at a high speed so that water is separated from the laundry by a centrifugal force. After completion of the dewatering cycle, a user pulls the washed and dewatered laundry out of the washing machine via the door 135.

Meanwhile, if a drying function is provided to the washing machine, hot air is supplied to the drum 320 to completely dry the laundry after completion of the dewatering cycle. The user is then provided with the completely dried laundry. Accordingly, in the control panel assembly the present invention, a pair of the decoration members differing in diameter encloses the corresponding button to have a compact configuration. And, a pair of the decoration members is easily assembled to be loaded in the control panel, whereby the compact decoration member and control panel assembly is provided to reduce a product cost. Moreover, the control panel assembly is easily assembled to enhance productivity. Accordingly, the present invention is applicable to such a home appliance as a dryer and the like as well as a washing machine.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A control panel assembly for a washing machine, comprising:

a control panel mounted on an outer case of the washing machine, the control panel comprising, a first opening penetrated by a first decoration member and at least one hook extending backward from a rear circumferential edge of the first opening;

a push button enclosed by the first decoration member;

a second decoration member enclosing the first decoration member, the second decoration member supporting a rear side of the first decoration member, the second decoration member being supported by the control panel and the first decoration member; and a transparent cover covering a front side of the control panel and supporting a front portion of the first decoration member, wherein the at least one hook comprises a first hook fastened to a rear side of the second decoration member and a second hook fastened to a portion of the first decoration member.

2. The control panel assembly of claim 1, wherein the control panel comprises an information sheet attached to the front side of the control panel.

3. The control panel assembly of claim 1, wherein the first opening has a diameter greater than that of the first decoration member, and wherein a front portion of the second decoration member is provided between an inner surface of the first opening and an outer surface of the first decoration member.

4. The control panel assembly of claim 1, wherein the first decoration member comprises:

an opening accommodating the push button;

an extension extending backward from the rear side of the first decoration member and being bent to support a rear side of the second decoration member in part; and a stepped portion provided along an outer circumference of the front portion of the first decoration member to be supported by the cover.

5. The control panel assembly of claim 4, wherein the control panel comprises a hook extending backward from a rear side of the control panel to be fastened to the extension of the first decoration member.

6. The control panel assembly of claim 1, wherein the second decoration member comprises:

a transparent layer provided between an outer circumference of the first decoration member and the control panel; and an information sheet attached to the transparent layer.

7. The control panel assembly of claim 1, wherein the second decoration member comprises:

an opening accommodating the first decoration member;

a first stepped portion provided along an outer circumference of the second decoration member to be in contact with the control panel; and a second stepped portion provided along an inner circumference of the second decoration member to support the rear side of the first decoration member.

8. The control panel assembly of claim 7, wherein the second decoration member further comprises a channel perforating the second stepped portion to be penetrated by a portion of the first decoration member.

9. The control panel assembly of claim 1, wherein the first and second decorations are ring-shaped, respectively.

10. The control panel assembly of claim 1, wherein the transparent cover comprises:

an opening accommodating the front portion of the first decoration; and at least one extension stably fitted to the control panel.

11. A control panel assembly for a washing machine, comprising:

a control panel mounted on an outer case of the washing machine, the control panel comprising:

a first opening; and at least one hook extending backward from a rear circumferential edge of the first opening;

a first decoration member inserted in the first opening, the first decoration member comprising a second opening to accommodate a push button therein;

a second decoration member supported by a rear side of the control panel and the hook, the second decoration member comprising a third opening to accommodate the first decoration member therein; and a transparent cover covering a front side of the control panel, the transparent cover comprising a fourth opening to accommodate a front portion of the first decoration member.

12. The control panel assembly of claim 11, wherein the control panel comprises an information sheet attached to the front side of the control panel.

13. The control panel assembly of claim 11, wherein the first opening has a diameter greater than that of the first decoration member, and wherein a front portion of the second decoration member is provided between an inner surface of the first opening and an outer surface of the first decoration member.

14. The control panel assembly of claim 11, wherein the at least one hook comprises:

a first hook fastened to a rear side of the second decoration; and a second hook fastened to a portion of the first decoration.

15. The control panel assembly of claim 11, wherein the first decoration member further comprises:

an extension extending backward from the rear side of the first decoration member and being bent to support a rear side of the second decoration member in part; and a stepped portion provided along an outer circumference of the front portion of the first decoration member to be supported by the cover.

16. The control panel assembly of claim 11, wherein the second decoration member comprises:

a transparent layer provided between an outer circumference of the first decoration member and the control panel; and an information sheet attached to the transparent layer.

17. The control panel assembly of claim 11, wherein the second decoration member further comprises:

a first stepped portion provided along an outer circumference of the second decoration member to be in contact with the control panel; and a second stepped portion provided along an inner circumference of the second decoration member to support the rear side of the first decoration member.

18. The control panel assembly of claim 17, wherein the second decoration member further comprises a channel perforating the second stepped portion to be penetrated by a portion of the first decoration member.

19. The control panel assembly of claim 11, wherein the transparent cover further comprises:

at least one extension stably fitted in the control panel; and at least one aperture enabling to be penetrated by a locking member.

20. A control panel assembly for a washing machine, comprising:

a control panel mounted on a case of the washing machine, the control panel comprising:

a first opening; and first and second hooks, each hook extending backward from a rear circumferential edge of the first opening;

a first decoration member inserted in the first opening, the first decoration member comprising:

a second opening to accommodate a push button therein;

a first extension extending from a rear side of the first decoration member to have the second hook fastened to an end portion of the first extension; and a first stepped portion provided along an outer circumference of a front portion of the first decoration member;

a second decoration member having the first hook fastened to a rear side of the second decoration, the second decoration member comprising:

a third opening to accommodate the first decoration member therein;

a second stepped portion provided along an outer circumference of the second decoration member to be held in the first opening; and a third stepped portion provided along an inner circumference of the second decoration member to support the rear side of the first decoration; and a transparent cover covering a front side of the control panel, the transparent cover comprising:

a fourth opening to accommodate the first stepped portion; and at least one second extension stably fitted to the control panel to be fixed thereto.

21. The control panel assembly of claim 20, wherein the control panel further comprises an information sheet attached to the front side of the control panel.

22. The control panel assembly of claim 20, wherein the second decoration member further comprises:

a transparent layer provided between an outer circumference of the first decoration member and the control panel; and an information sheet attached to the transparent layer.

23. The control panel assembly of claim 20, wherein the second decoration member further comprises a channel perforating the third stepped portion to be penetrated by a portion of the first decoration member.

* * * * *